US009955830B1

(12) United States Patent
Harris et al.

(10) Patent No.: US 9,955,830 B1
(45) Date of Patent: May 1, 2018

(54) DEVICE FOR HOLDING MALE GENITALIA ADJACENT TO A TOILET SEAT

(71) Applicants: Constance Harris, Ft Lauderdale, FL (US); Shakia Burton, Ft Lauderdale, FL (US)

(72) Inventors: Constance Harris, Ft Lauderdale, FL (US); Shakia Burton, Ft Lauderdale, FL (US)

( * ) Notice: Subject to any disclaimer, the term of this patent is extended or adjusted under 35 U.S.C. 154(b) by 0 days. days.

(21) Appl. No.: 15/458,142

(22) Filed: Mar. 14, 2017

(51) Int. Cl.
*A47K 17/02* (2006.01)
*A47K 13/24* (2006.01)

(52) U.S. Cl.
CPC ..... *A47K 17/02* (2013.01); *A47K 13/24* (2013.01)

(58) Field of Classification Search
CPC ..... A47K 13/14; A47K 17/02
USPC ..... 4/300.3
See application file for complete search history.

(56) References Cited

U.S. PATENT DOCUMENTS 2,407,005 A * 9/1946 Haley ..... E03D 9/00 4/231
3,486,172 A * 12/1969 Gleichert ..... E03D 11/00 4/300.3
3,614,790 A * 10/1971 Billingsly ..... E03D 11/00 4/300.3
4,910,815 A 3/1990 Kelley
4,975,990 A 12/1990 Chan
D354,124 S * 1/1995 DeJonge ..... D23/310
5,960,481 A 10/1999 Deveer
6,408,447 B1 * 6/2002 Burbank ..... A47K 13/24 4/300.3
6,513,172 B1 * 2/2003 Norton ..... A47K 13/24 4/300.3
6,948,195 B2 9/2005 Culmer
7,007,313 B1 3/2006 Johnson
7,225,481 B2 6/2007 Culmer
9,145,667 B1 9/2015 Laurent
2004/0111791 A1 6/2004 Summers
2006/0168713 A1 8/2006 Williams
2008/0016607 A1 * 1/2008 Cottage ..... A47K 13/24 4/300.3

FOREIGN PATENT DOCUMENTS

WO 2015160737 A1 10/2015

* cited by examiner

*Primary Examiner* — Janie Loeppke

(57) ABSTRACT

The device for holding male genitalia adjacent a toilet seat is an apparatus that may be installed temporarily on the front, inside edge of a toilet seat. When installed on a toilet seat, the apparatus provides support for a user's penis while the user is seated on the toilet. In so doing, the apparatus prevents the user's genitalia from touching water in the toilet or the toilet itself. The apparatus is easily installed by sliding U-shaped clips onto the front of the toilet seat.

10 Claims, 3 Drawing Sheets

DEVICE FOR HOLDING MALE GENITALIA ADJACENT TO A TOILET SEAT

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of personal hygiene, more specifically, a device for supporting male genitalia adjacent to a toilet seat.

SUMMARY OF INVENTION

The device for holding male genitalia adjacent a toilet seat is an apparatus that may be installed temporarily on the front, inside edge of a toilet seat. When installed on a toilet seat, the apparatus provides support for a user's penis while the user is seated on the toilet. In so doing, the apparatus prevents the user's genitalia from touching water in the toilet or the toilet itself. The apparatus is easily installed by sliding U-shaped clips onto the front of the toilet seat.

An object of the invention is to prevent male genitalia from touching a toilet or toilet water while seated on a toilet.

A further object of the invention is to allow the device for holding male genitalia adjacent a toilet seat to be easily installed on and removed from a toilet seat.

These together with additional objects, features and advantages of the device for holding male genitalia adjacent a toilet seat will be readily apparent to those of ordinary skill in the art upon reading the following detailed description of the presently preferred, but nonetheless illustrative, embodiments when taken in conjunction with the accompanying drawings.

In this respect, before explaining the current embodiments of the device for holding male genitalia adjacent a toilet seat in detail, it is to be understood that the device for holding male genitalia adjacent a toilet seat is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the device for holding male genitalia adjacent a toilet seat.

It is therefore important that the claims be regarded as including such equivalent construction insofar as they do not depart from the spirit and scope of the device for holding male genitalia adjacent a toilet seat. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description. As used herein, the word "or" is intended to be inclusive.

Figure 1:
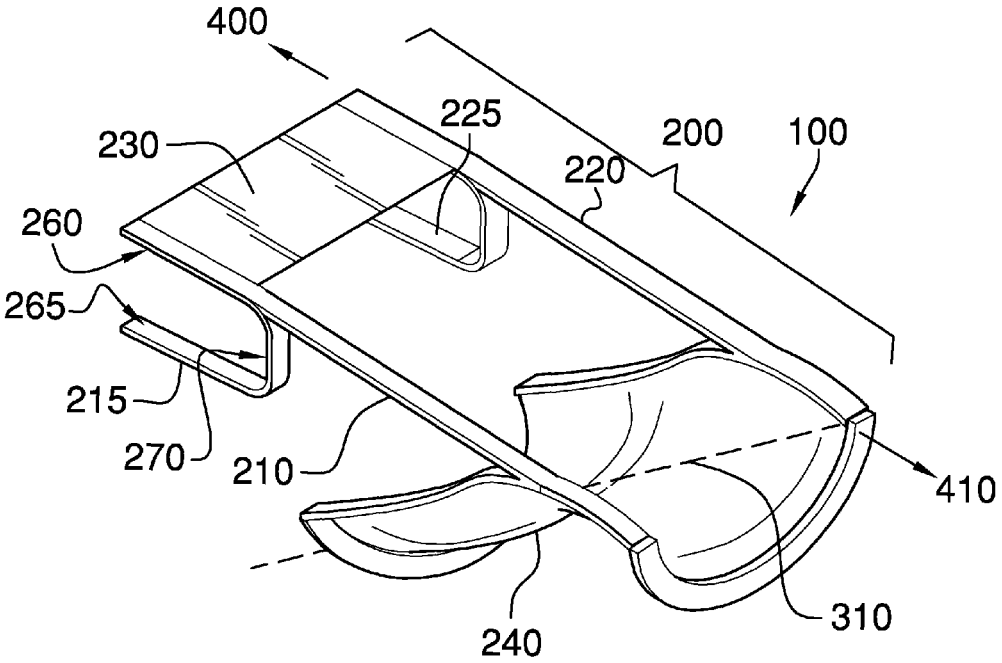
FIG. 1 is a perspective view of an embodiment of the disclosure.
Figure 2:
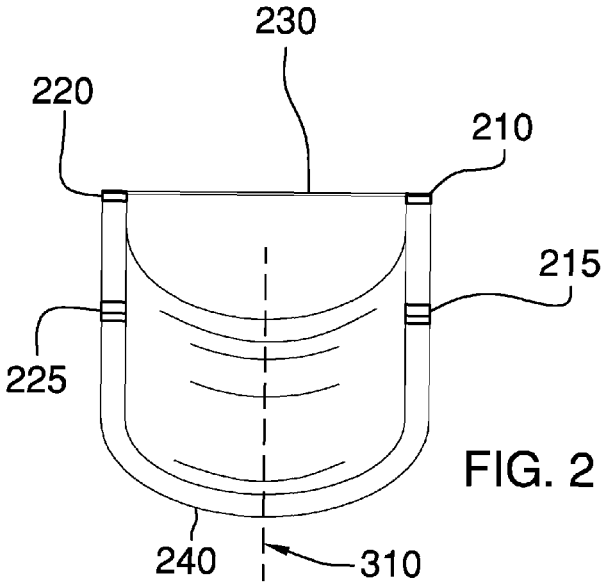
FIG. 2 is a front view of an embodiment of the disclosure.
Figure 3:
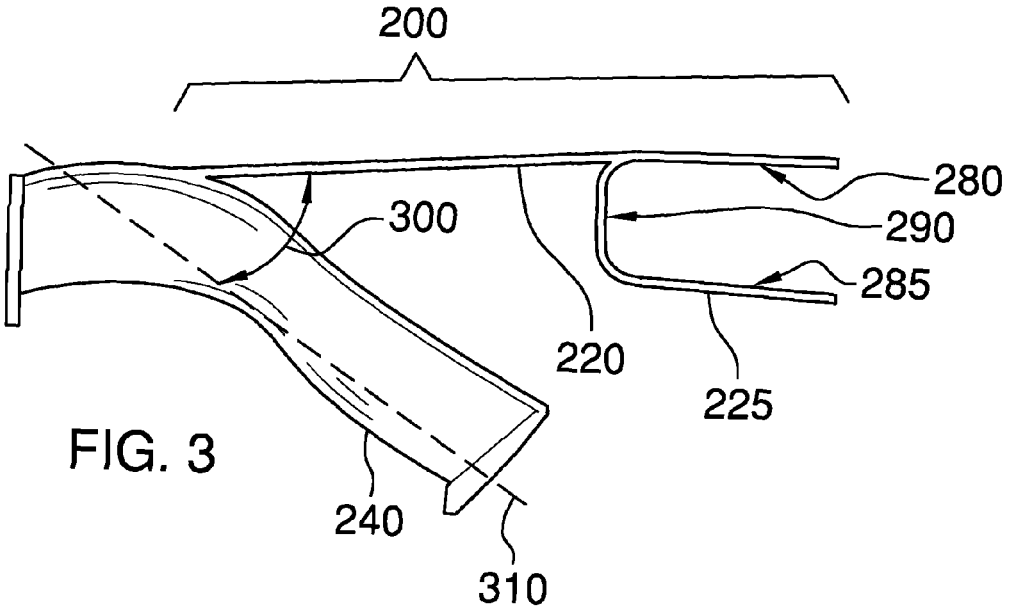
FIG. 3 is a side view of an embodiment of the disclosure.
Figure 4:
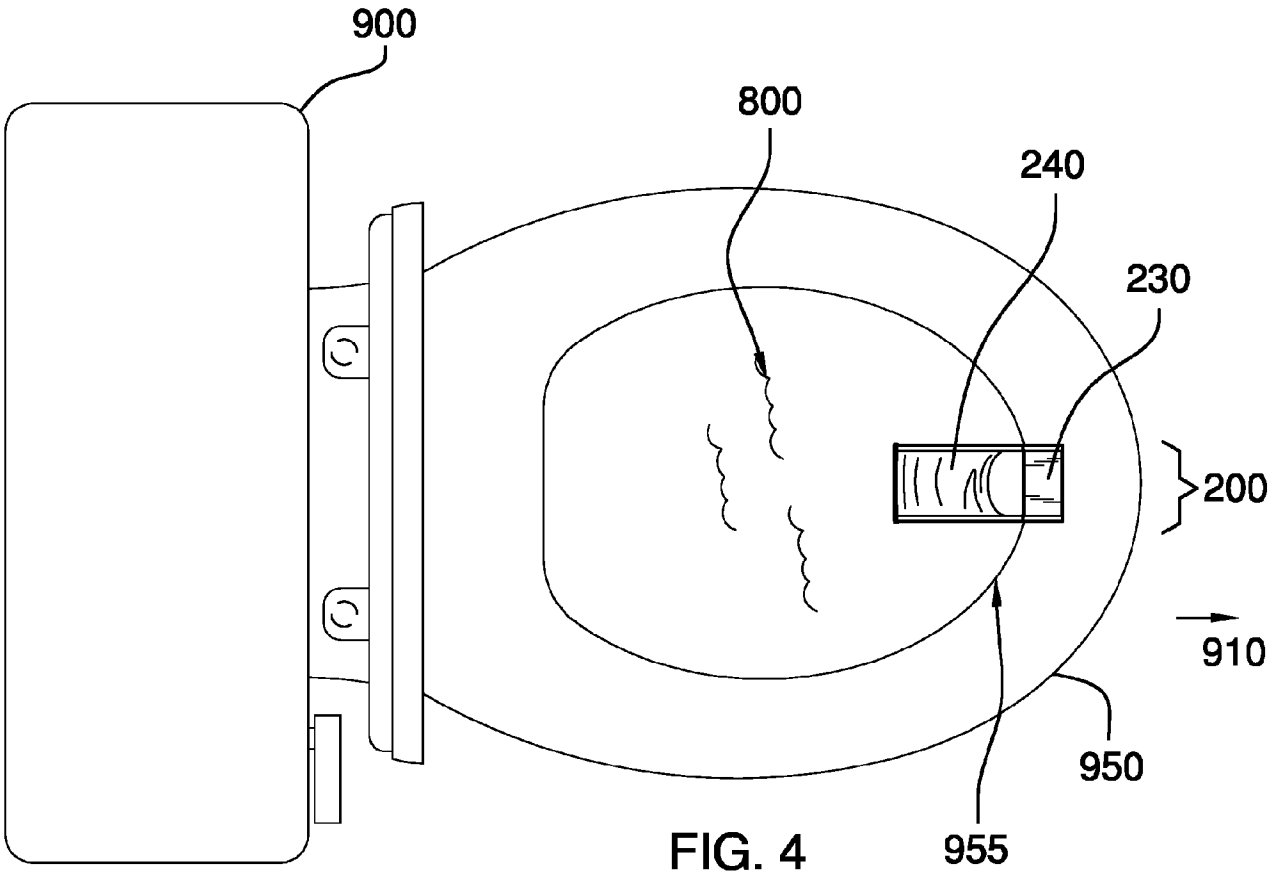
FIG. 4 is a top view of an embodiment of the disclosure.

Detailed reference will now be made to a first potential embodiment of the disclosure, which is illustrated in FIGS. 1 through 4.

The device for holding male genitalia adjacent a toilet seat 100 (hereinafter invention) is an apparatus which attaches to a toilet seat 950 and is adapted to prevent male genitalia from contacting a toilet 900 or water 800 in the toilet 900. The device for holding male genitalia adjacent a toilet seat 100 comprises a frame 200 and a support 240. The invention is adapted to allow the user's penis to rest on the support 240 when the invention is in held in place on the toilet seat 950 by the frame 200. The device for holding male genitalia adjacent a toilet seat 100 is adapted to allow the user's testicles and scrotum to hang between the user and a rear of the device 410. Throughout this document, 'in place' means that the invention is attached to an inside edge 955 of the toilet seat 950 directly in a front 910 of the seated user.

The frame 200 is an armature that attaches to the inside edge 955 of the toilet seat 950 at the front 910 of the toilet seat 950. The frame 200 holds the support 240 in position for proper use of the invention. The frame 200 comprises a left armature 210, a right armature 220, a left clip 215, a right clip 225 and a cross armature 230. The frame 200 uses the left clip 215 and the right clip 225 to attach to the toilet seat 950 at a front of the device 400. The frame 200 extends horizontally back towards the rear of the toilet seat 950 and is adapted to hold the support 240 above the water 800 directly in the front 910 of the seated user. The frame 200 may be constructed from metal or plastic.

The left armature 210 is a substantially straight support member. Substantially straight shall mean that the maximum lateral width due to curves or other irregularities in the shape of the left armature 210 is less than 10% of the longitudinal length of the left armature 210. When the device for holding male genitalia adjacent a toilet seat 100 is installed on the toilet seat 950, the left armature 210 is held in a horizontal orientation. At the front of the device 400, the left armature 210 is coupled to the left clip 215. At the rear of the device 410, the left armature 210 is coupled to the left side of the support 240. The length of the left armature 210 is no less than 25 mm and no greater than 150 mm.

The right armature 220 is a substantially straight support member. Substantially straight shall mean that the maximum lateral width due to curves or other irregularities in the shape of the right armature 220 is less than 10% of the longitudinal length of the right armature 220. When the device for holding male genitalia adjacent a toilet seat 100 is installed on the toilet seat 950, the right armature 220 is held in a horizontal orientation. At the front of the device 400, the right armature 220 is coupled to the right clip 225. At the rear of the device 410, the right armature 220 is coupled to the right side of the support 240. The length of the right armature 220 is no less than 25 mm and no greater than 150 mm. The left armature 210 and the right armature 220 are substantially parallel to each other and are separated from each other by a distance of no less than 25 mm and no greater than 125 mm. Substantially parallel shall mean that the left armature 210 is inclined from being exactly parallel to the right armature 220 by an angle of not more than 10°.

The left clip 215 is a 'U'-shaped member coupled to the left armature 210 at the front of the device 400. When the invention is installed on the toilet seat 950, the left clip 215 is oriented with the 'U' on its side and with a portion of the 'U' extending down from the left armature 210 towards the water 800. When installed, an upper side of the left clip 260 is located above the toilet seat 950 and a lower side of the left clip 265 is located below the toilet seat 950. The upper side of the left clip 260 is coupled to the left armature 210 at the end of the left armature 210 that is opposite the support 240. A rear side of the left clip 270 limits the distance that the left clip 215 can move forward on the toilet seat 950. Tension from the upper side of the left clip 260 and the lower side of the left clip 265 against the toilet seat 950 holds the left clip 215 and, by extension, the left side of the invention in place.

The right clip 225 is a 'U'-shaped member coupled to the right armature 220 at the front of the device 400. When the invention is installed on the toilet seat 950, the right clip 225 is oriented with the 'U' on its side and with a portion of the 'U' extending down from the right armature 220 towards the water 800. When installed, an upper side of the right clip 280 is located above the toilet seat 950 and a lower side of the right clip 285 is located below the toilet seat 950. The upper side of the right clip 280 is coupled to the right armature 220 at the end of the right armature 220 that is opposite the support 240. A rear side of the right clip 290 limits the distance that the right clip 225 can move forward on the toilet seat 950. Tension from the upper side of the right clip 280 and the lower side of the right clip 285 against the toilet seat 950 holds the right clip 225 and, by extension, the right side of the invention in place.

The cross armature 230 connects to the left armature 210 at the front of the device 400. The cross armature 230 connects to the right armature 220 at the front of the device 400. In doing so, the cross armature 230 provides stability to the frame 200.

The support 240 is adapted to hold the user's penis at a support angle 300 with respect to horizontal. If the support angle 300 is too small, meaning approaching 0°, then the user's penis will essentially be oriented horizontally and the stream of urine expressed by the user may hit the toilet seat 950 or go under the toilet seat 950, and outside of the toilet 900. If the support angle 300 is too large, meaning approaching 90°, then the user's penis will essentially be oriented vertically and may touch the water 800 or the toilet 900. The support angle is between 0° and 90°. In a preferred embodiment, the support angle 300 is between 20° and 70°. The support angle 300 is measured as the angle between horizontal and a support centerline 310. The support centerline 310 is defined to be a straight line drawn on the top surface of the support 240 midway between the left armature 210 and the right armature 220.

In use, the device for holding male genitalia adjacent a toilet seat 100 is attached to the toilet seat 950 by placing the left clip 215 and the right clip 225 against the inside edge 955 of the toilet seat 950 at the front 910 of the toilet seat 950 and pushing it forward until the rear side of the left clip 270 and the rear side of the right clip 290 prevent further forward movement. The user then sits on the toilet seat 950 and places his penis onto the support 240. When finished urinating, the user stands up and removes the device for holding male genitalia adjacent a toilet seat 100 from the toilet seat 950 by pulling it towards the back of the toilet seat 950 until the left clip 215 and the right clip 225 release their grip on the toilet seat 950. If necessary, the device for holding male genitalia adjacent a toilet seat 100 may then be cleaned and dried before being stored until needed for further use.

With respect to the above description, it is to be realized that the optimum dimensional relationship for the various components of the invention described above and in FIGS. 1 through 4, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A device for holding male genitalia adjacent a toilet seat comprising:

a frame and a support;

wherein the device for holding male genitalia adjacent a toilet seat attaches to a toilet seat;

wherein the device for holding male genitalia adjacent a toilet seat is adapted to prevent male genitalia from contacting a toilet or water in the toilet;

wherein the device for holding male genitalia adjacent a toilet seat is held in place on the toilet seat by the frame;

wherein the device for holding male genitalia adjacent a toilet seat is adapted to allow a user's penis to rest on the support;

wherein the device for holding male genitalia adjacent a toilet seat is adapted to allow a user's testicles and scrotum to hang between the user and a rear of the device;

wherein the frame is an armature that attaches to an inside edge of the toilet seat at a front of the toilet seat;

wherein the frame holds the support in position for use of the device for holding male genitalia adjacent a toilet seat;

wherein the frame comprises a left armature, a right armature, a left clip, a right clip and a cross armature;

wherein the frame uses the left clip and the right clip to attach to the toilet seat at a front of the device;

wherein the frame extends horizontally towards a rear of the toilet seat;

wherein the frame is adapted to hold the support above the water directly in front of the seated user;

wherein the left armature is a substantially straight support member;

wherein when the device for holding male genitalia adjacent a toilet seat is installed on the toilet seat the left armature is held in a horizontal orientation;

wherein the left armature is coupled to the left clip at the front of the device;

wherein the left armature is coupled to the left side of the support at the rear of the device;

wherein the right armature is a substantially straight support member;

wherein when the device for holding male genitalia adjacent a toilet seat is installed on the toilet seat the right armature is held in a horizontal orientation;

wherein the right armature is coupled to the right clip at the front of the device;

wherein the right armature is coupled to the right side of the support at the rear of the device;

wherein the left armature and the right armature are substantially parallel to each other;

wherein the left clip is a 'U'-shaped member coupled to the left armature at the front of the device;

wherein when the device for holding male genitalia adjacent a toilet seat is installed on the toilet seat, the left clip is oriented with the 'U' on its side and with a portion of the 'U' extending down from the left armature towards the water;

wherein when the device for holding male genitalia adjacent a toilet seat is installed on the toilet seat, an upper side of the left clip is located above the toilet seat and a lower side of the left clip is located below the toilet seat;

wherein the upper side of the left clip is coupled to the left armature at the end of the left armature that is opposite the support;

wherein tension from the upper side of the left clip and the lower side of the left clip against the toilet seat holds the left clip and, by extension, the left side of the device for holding male genitalia adjacent a toilet seat in place.

2. The device for holding male genitalia adjacent a toilet seat according to claim 1 wherein the length of the left armature is no less than 25 mm and no greater than 150 mm.

3. The device for holding male genitalia adjacent a toilet seat according to claim 2 wherein the length of the right armature is no less than 25 mm and no greater than 150 mm.

4. The device for holding male genitalia adjacent a toilet seat according to claim 3 wherein the left armature and the right armature are separated from each other by a distance of no less than 25 mm and no greater than 125 mm.

5. The device for holding male genitalia adjacent a toilet seat according to claim 1 wherein a rear side of the left clip limits the distance that the left clip can move forward on the toilet seat.

6. The device for holding male genitalia adjacent a toilet seat according to claim 5 wherein the right clip is a 'U'-shaped member coupled to the right armature at the front of the device;

wherein when the device for holding male genitalia adjacent a toilet seat is installed on the toilet seat, the right clip is oriented with the 'U' on its side and with a portion of the 'U' extending down from the right armature towards the water;

wherein when the device for holding male genitalia adjacent a toilet seat is installed on the toilet seat, an upper side of the right clip is located above the toilet seat and a lower side of the right clip is located below the toilet seat;

wherein the upper side of the right clip is coupled to the right armature at the end of the right armature that is opposite the support;

wherein tension from the upper side of the right clip and the lower side of the right clip against the toilet seat holds the right clip and, by extension, the right side of the device for holding male genitalia adjacent a toilet seat in place.

7. The device for holding male genitalia adjacent a toilet seat according to claim 6 wherein a rear side of the right clip limits the distance that the right clip can move forward on the toilet seat.

8. The device for holding male genitalia adjacent a toilet seat according to claim 7 wherein the cross armature provides stability to the frame by coupling to the left armature at the front of the device and to the right armature at the front of the device.

9. The device for holding male genitalia adjacent a toilet seat according to claim 8 wherein the support is adapted to hold the user's penis at a support angle with respect to horizontal;

wherein the support angle is between 0° and 90°.

10. The device for holding male genitalia adjacent a toilet seat according to claim 9 wherein the support angle is between 20° and 70°.

* * * * *